US012745843B2

(12) United States Patent
Xie

(10) Patent No.: US 12,745,843 B2
(45) Date of Patent: Sep. 29, 2026

(54) HANGING CHAIR

(71) Applicant: FOSHAN ZHUANYI METAL TECHNOLOGY CO., LTD., Foshan (CN)

(72) Inventor: Yefang Xie, Foshan (CN)

(73) Assignee: FOSHAN ZHUANYI METAL TECHNOLOGY CO., LTD., Foshan (CN)

( * ) Notice: Subject to any disclaimer, the term of this patent is extended or adjusted under 35 U.S.C. 154(b) by 108 days.

(21) Appl. No.: 18/827,725

(22) Filed: Sep. 7, 2024

(65) Prior Publication Data

US 2026/0053267 A1 Feb. 26, 2026

(30) Foreign Application Priority Data

Aug. 21, 2024 (CN) ..... 202422041769.X

(51) Int. Cl.
*A45F 3/26* (2006.01)
*A47C 3/025* (2006.01)

(52) U.S. Cl.
CPC ..... *A47C 3/0255* (2013.01); *A45F 3/26* (2013.01)

(58) Field of Classification Search
CPC ..... A45F 3/26; A47C 3/0255; A47C 4/42; A47C 4/28; A47C 4/283; A47C 4/286; A47C 4/44; A47C 4/46
See application file for complete search history.

(56) References Cited

U.S. PATENT DOCUMENTS

| | | | | |
|---|---|---|---|---|
| 6,824,210 | B2 * | 11/2004 | Zheng | A47C 4/42 297/23 |
| 8,464,512 | B2 * | 6/2013 | Vauchel | B64D 29/06 60/226.3 |
| 9,775,438 | B1 * | 10/2017 | Schulenberg | A47C 7/748 |
| 10,426,271 | B2 * | 10/2019 | Elmi | F16M 11/38 |
| 10,631,647 | B1 * | 4/2020 | Wu | A45F 3/24 |
| D929,137 | S * | 8/2021 | Shen | D6/347 |
| D931,629 | S * | 9/2021 | Xie | D6/347 |
| D935,205 | S * | 11/2021 | Xie | D6/347 |
| D938,179 | S * | 12/2021 | Wehner | D6/369 |
| 11,540,636 | B1 * | 1/2023 | Yu | A47C 4/02 |
| 11,896,096 | B2 * | 2/2024 | LeAnna | F16M 11/14 |
| 12,004,645 | B2 * | 6/2024 | Hofmann | A47B 91/02 |
| 12,232,609 | B1 * | 2/2025 | Van Raalte | A47C 7/008 |
| 2013/0175836 | A1 * | 7/2013 | Chen | A47C 1/0342 297/354.1 |
| 2022/0183467 | A1 * | 6/2022 | Sze | A45F 3/26 |

FOREIGN PATENT DOCUMENTS

| | | | |
|---|---|---|---|
| CN | 211501324 U | * | 9/2020 |
| CN | 213465288 U | * | 6/2021 |
| CN | 215993364 U | * | 3/2022 |

(Continued)

*Primary Examiner* — Timothy J Brindley

(57) ABSTRACT

A hanging chair is provided, which includes a frame, a seat, and a plurality of backrest rods. The seat is disposed on a side of the frame and connected with a bottom of the frame. The plurality of backrest rods are disposed on a side of the frame and arranged at intervals along a longitudinal direction of the frame, the plurality of backrest rods are rotatably disposed on the frame, and at least some of the backrest rods each has at least one end spherically connected with the frame.

4 Claims, 4 Drawing Sheets

(56) References Cited

FOREIGN PATENT DOCUMENTS

| | | | | | |
|---|---|---|---|---|---|
| CN | 217792112 | U | * | 11/2022 | A47C 4/28 |
| DE | 102018003198 | A1 | * | 10/2019 | A45F 3/26 |
| GB | 2508369 | A | * | 6/2014 | A45F 3/26 |
| KR | 101503700 | B1 | * | 3/2015 | A47C 4/286 |
| WO | WO-2024102020 | A1 | * | 5/2024 | A47C 4/00 |

* cited by examiner

HANGING CHAIR

TECHNICAL FIELD

The present disclosure relates to the technical field of hanging chairs, in particular to a hanging chair.

BACKGROUND

A hanging chair (also known as a hammock chair) is a type of chair that can be suspended and swung, typically used for leisure and relaxation.

To facilitate transportation and assembly, the hanging chair is generally designed to be foldable. In related art, backrest rods of the hanging chair may get stuck when rotating relative to a frame of the hanging chair, which results in unsmooth folding and unfolding of the hanging chair, making it inconvenient to use.

SUMMARY

A main objective of the present disclosure is to provide a hanging chair, to allow folding and unfolding of the hanging chair to be smoother.

To realize the above objective, the present disclosure provides a hanging chair, including:

a frame;

a seat disposed on a side of the frame and connected with a bottom of the frame; and a plurality of backrest rods disposed on a side of the frame and arranged at intervals along a longitudinal direction of the frame, the plurality of backrest rods being rotatably arranged on the frame, and at least some of the plurality of backrest rods each has at least one end spherically connected with the frame.

In some embodiments, at least some of the plurality of backrest rods each has two opposite ends spherically connected with the frame; and/or, all of the plurality of backrest rods are spherically connected with the frame.

In some embodiments, of the frame and each the backrest rod which is spherically connected with the frame, one is provided with a ball connecting member, and the other is provided with a limiting member. The limiting member is defined with an accommodating cavity, and the ball connecting member is rotatably mated in the accommodating cavity, to allow the backrest rod to be spherically connected with the frame.

In some embodiments, the ball connecting member is arranged on the frame, and the limiting member is arranged on the backrest rod.

In some embodiments, the limiting member is a limiting sleeve, and a partition part is disposed in the limiting sleeve. The partition part is configured to partition an inner cavity of the limiting sleeve into a socket cavity and the accommodating cavity, and the backrest rod is inserted into the socket cavity and connected with the limiting sleeve.

In some embodiments, the limiting sleeve is defined with a first connecting hole, the backrest rod is defined with a second connecting hole corresponding to the first connecting hole, and the limiting sleeve is connected to the backrest rod by a first fastener mating with the first connecting hole and the second connecting hole.

In some embodiments, the ball connecting member includes a ball head part and a connecting part connected with the ball head part, and a connecting column is protruded on the frame. The connecting column is defined with an insertion hole, the connecting part is inserted into the insertion hole and connected with the connecting column, and the ball head part of the ball connecting member is accommodated in the accommodating cavity.

In some embodiments, the connecting part is defined with a third connecting hole, the connecting column is defined with a fourth connecting hole corresponding to the third connecting hole, and the connecting column is connected to the connecting part by a second fastener mating with the third connecting hole and the fourth connecting hole.

In some embodiments, the accommodating cavity is defined with an opening in an end surface of the limiting member, a side surface of the limiting member is defined with an avoidance opening communicated with the accommodating cavity, and the avoidance opening is configured to allow a rotation of the ball connecting member relative to the limiting member.

In some embodiments, the seat is rotatably arranged on the frame; and/or, the seat and the plurality of backrest rods are connected by connecting straps.

According to the present disclosure, the backrest rods of the hanging chair are rotatably arranged relative to the frame for folding and unfolding. Since at least some of the backrest rods each has at least one end spherically connected with the frame, it allows the backrest rod that is spherically connected with the frame to rotate more flexibly with respect to the frame, thus the backrest rod is less likely to get stuck. This allows the folding and unfolding of the hanging chair to be smoother, making the hanging chair more convenient to use.

DETAILED DESCRIPTION OF THE EMBODIMENTS

Figure 1:
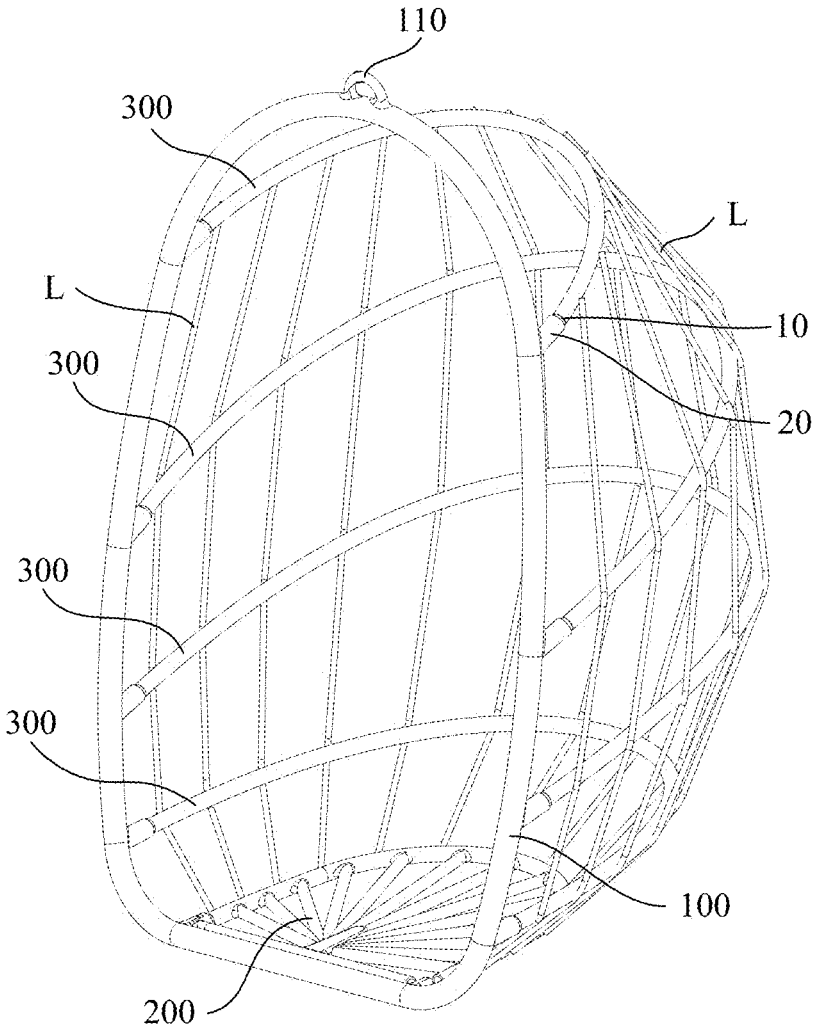
FIG. 1 is a schematic structural diagram of a hanging chair according to an embodiment of the present disclosure.

The technical solutions in the embodiments of the present disclosure will be described clearly and completely with reference to the accompanying drawings in the embodiments of the present disclosure. Obviously, the described embodiments are only a part of the embodiments of the present disclosure rather than all of them. Based on the embodiments in the present disclosure, all other embodiments obtained by those skilled in the art without creative work shall fall within the scope of protection of the present disclosure.

It should be noted that all directional indications (such as up, down, left, right, front, back) in the embodiments of the present disclosure are merely used to explain relative position relationships or motion conditions between the components in a specific attitude (as shown in the drawings). The directional indication changes as the specific attitude changes.

It should be noted that when an element is described as "being fixed on" or "being arranged on" another element, the element may be directly arranged on the another element or there may be an intermediate element. When an element is described as "being connected to" another element, the element may be directly connected to the another element or there may be an intermediate element.

Moreover, the terms "first", "second", and the like in the present disclosure are merely used for description and cannot be understood as indicating or implying their relative importance or as implicitly indicating the quantity of the technical features indicated. Thus, the feature defined by "first" or "second" may explicitly or implicitly include at least one such feature. In addition, the technical solutions of various embodiments may be combined with each other, but must be based on that the combined technical solutions can be implemented by those skilled in the art. When the combination of the technical solutions is contradictory or impossible to realize, it shall be considered that such combination does not exist and is not within the scope of protection of the present disclosure.

The embodiments of the present disclosure provide a hanging chair.

Referring to FIG. 1, the hanging chair includes a frame 100, a seat 200, and a plurality of backrest rods 300. The seat 200 is disposed on a side of the frame 100 and connected to a bottom of the frame 100. The plurality of backrest rods 300 are disposed on a side of the frame 100 and arranged at intervals along a longitudinal direction of the frame 100. The plurality of backrest rods 300 are rotatably arranged on the frame 100, and at least some of the plurality of backrest rods 300 each has at least one end spherically connected with the frame 100.

The frame 100 may have various shapes, such as square, oval, circular. The frame 100 is defined with a frame opening 100A through which a user may sit in the hanging chair. The frame 100 serves as a structural main body of the hanging chair. By connecting the frame 100 to an installation object, the hanging chair can be hung/suspended on the installation object. As an example, the top end of the frame 100 may be provided with a lifting ring 110, and the lifting ring 110 is connected to the installation object (such as a hanging chair stand, a beam, or a wall) by a hanging chain or a hanging rope, to realize the hanging/suspension of the hanging chair on the installation object.

The seat 200 may have a rod frame structure. For example, the seat 200 includes a surrounding rod defining an accommodating space, and multiple support rods located in the accommodating space and connected with the surrounding rod. The seat 200 may also have a plate-like structure, which is not limited herein. The seat 200 is arranged on a side of the frame 100. Specifically, the front side of the frame 100 faces the human body, and the seat 200 is arranged on the rear side of the frame 100. In addition, the seat 200 is connected to the bottom of the frame 100 by means of rotatable connection, detachable connection, or the like, which is not limited herein. In a configuration that the seat 200 is rotatably connected to the frame 100, the seat 200 may rotate relative to the frame 100 for folding or unfolding. In a configuration that the seat 200 is detachably connected to the frame 100, the seat 200 may be detached from the frame 100 for storage. The detachable connection may be a snap-fit connection, a screw connection, or the like. When using the hanging chair, users may sit on the seat 200 through the frame opening 100A of the frame 100. A cushion may be provided on the seat 200. When users sit on the seat 200, the cushion provides support, thus enhancing the comfort of using the hanging chair.

The backrest rod 300 may be a curved rod with a U-shaped overall shape. The U-shaped structure of the backrest rod 300 may provide a wrap-around feeling for the user when using the hanging chair. Taking the longitudinal direction of the frame 100 as a reference direction, the plurality of backrest rods 300 are arranged at intervals on the rear side of the frame 100 to work together to provide support to the user. Specifically, when siting on the seat 200, the user may lean back against the backrest rods 300. The backrest rods 300 at different height positions (along the height direction of the frame 100) have differences in their sizes. For example, in the height direction of the frame 100, the size of the backrest rod 300 located at the middle position is the largest, the sizes of the backrest rods 300 located above the middle position gradually decrease, and the sizes of the backrest rods 300 located below the middle position also gradually decrease. The two opposite ends of each backrest rod 300 are connected to the frame 100, and each backrest rod 300 is rotatably arranged on the frame 100. The backrest rod 300 can rotate relative to the frame 100 to a folded position parallel or substantially parallel to the frame 100, thereby realizing folding; or the backrest rod 300 can rotate relative to the frame 100 to an unfolded position where it forms an angle with the frame 100, such as 45°, 60°, or 90°, thereby realizing unfolding. At least some of the plurality backrest rods 300 each has at least one end spherically connected with the frame 100. The spherical connection, also known as spherical hinge, is a mechanical connection that allows three degrees of freedom for rotation between two components, which typically include a spherical head and a bowl-shaped seat mated with the spherical head. The structure is compact and occupies a small space, thus can withstand large radial and axial loads, adapt to complex motion trajectories, and ensure the stability of the connection. In some embodiments, some or all of the plurality of backrest rods 300 each has one end spherically connected with the frame 100 and the other end connected with the frame by other means (such as planar hinge). In some other embodiments, some or all of the plurality of backrest rods 300 each has two opposite ends spherically connected with the frame 100. Taking four backrest rods 300 as an example, one, two, or three of the backrest rods 300 each has its one end spherically connected to the frame 100 and the other end connected to the frame 100 in another rotational connection manner (such as planar hinge); or, all four backrest rods 300 each has its one end spherically connected to the frame 100 and the other end connected to the frame 100 in another rotational connection manner (such as planar hinge); or, one, two, or three of the backrest rods 300 each has its two opposite ends spherically connected to the frame 100; or, all four backrest rods 300 each has its two opposite ends spherically connected to the frame 100. In this embodiment of the present disclosure, each of the plurality of backrest rods 300 has its two opposite ends spherically connected with the frame 100. A cushion may be provided at the backrest rods 300. When a user leans back against the backrest rods 300, the cushion provides support, enhancing the comfort of using the hanging chair.

According to the embodiments, the plurality of backrest rods 300 of the hanging chair are rotatably arranged relative to the frame 100 for folding or unfolding the hanging chair. Since at least some of the plurality of backrest rods 300 each has at least one end spherically connected with the frame 100, it allows the backrest rod 300 that is spherically connected with the frame 100 to rotate more flexibly relative to the frame 100, thus the backrest rod is less likely to get stuck. This allows the folding and unfolding of the hanging chair to be smoother, making the hanging chair more convenient to use.

In some embodiments, at least some of the plurality of backrest rods 300 each has two opposite ends spherically connected with the frame 100; and/or, all of the plurality of backrest rods 300 are spherically connected with the frame 100.

In the embodiments, for any backrest rod 300 that is spherically connected with the frame 100, the backrest rod 300 has its two opposite ends spherically connected with the frame 100. This allows the rotation of the backrest rod 300 rotating relative to the frame 100 more flexible and reduces the likelihood of the backrest rod 300 getting stuck during rotation, thereby allowing the hanging chair to be folded and unfolded more smoothly. In some embodiments, each of the plurality of backrest rods 300 is spherically connected with the frame 100, allowing for a flexible rotation of the backrest rod 300 relative to the frame 100. This reduces the chances of the backrest rod 300 getting stuck during rotation, thereby enhancing the overall smoothness of the folding and unfolding of the hanging chair.

Figure 2:
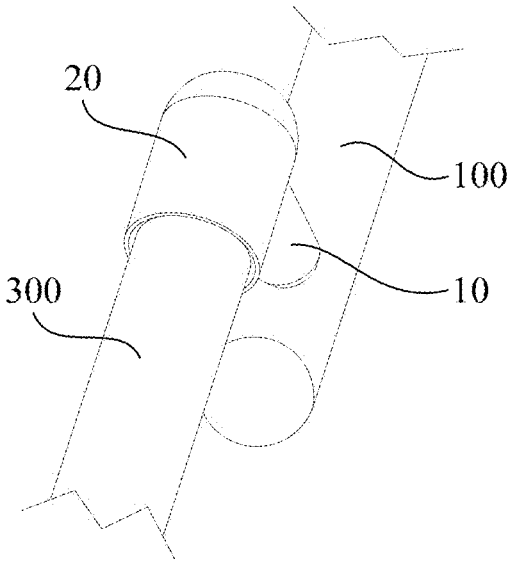
FIG. 2 is a schematic structural diagram of a part of the hanging chair in FIG. 1.
Figure 3:
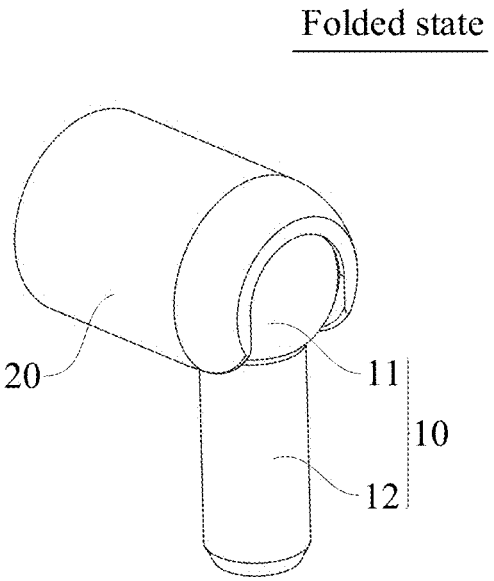
FIG. 3 is a schematic structural diagram of a part of a hanging chair according to an embodiment of the present disclosure.
Figure 4:
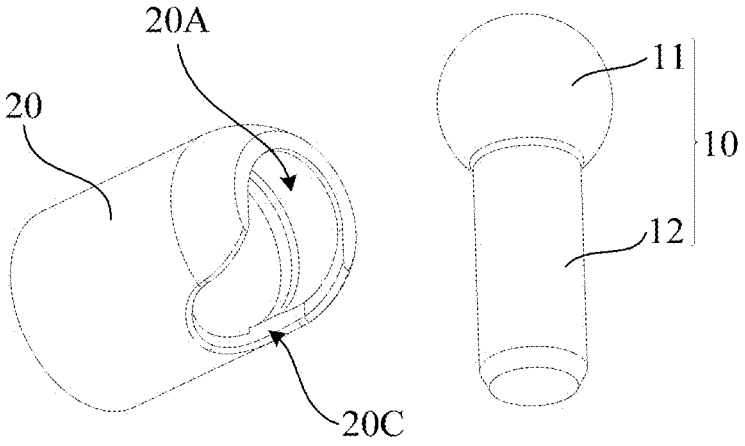
FIG. 4 is an exploded diagram of the part of the hanging chair in FIG. 3.

In some embodiments, referring to FIG. 2 to FIG. 4, one of the frame 100 and the backrest rod 300 that is spherically connected with the frame 100 is provided with a ball connecting member 10, and the other is provided with a limiting member 20. The limiting member 20 is defined with an accommodating cavity 20A. The ball connecting member 10 is rotatably mated in the accommodating cavity 20A, to realize the spherical connection between the backrest rod 300 and the frame 100.

In some embodiments, the frame 100 is provided with the ball connecting member 10, and the backrest rod 300 that is spherically connected with the frame 100 is provided with the limiting member 20. In this configuration, the ball connecting member 10 may be detachably connected or integrally formed with the frame 100, and the limiting member 20 may be detachably connected or integrally formed with the backrest rod 300, which is not limited herein. In some other embodiments, the frame 100 is provided with the limiting member 20, and the backrest rod 300 that is spherically connected with the frame 100 is provided with the ball connecting member 10. In this configuration, the limiting member 20 may be detachably connected or integrally formed with the frame 100, and the ball connecting member 10 may be detachably connected or integrally formed with the backrest rod 300, which is not limited herein.

When the backrest rod 300 is spherically connected to the frame 100, the ball connecting member 10 is accommodated in the accommodating cavity 20A defined by the limiting member 20, and the ball connecting member 10 is rotatably mated in the accommodating cavity 20A, thereby realizing the spherical connection between the backrest rod 300 and the frame 100. The inner wall of the accommodating cavity 20A may be provided with an arc surface fitted the ball connecting member 10, such that the ball connecting member 10 rotates against the inner wall of the accommodating cavity 20A when it is accommodated in the accommodating cavity 20A. When the backrest rod 300 is subjected to an external force that causes it to rotate, the ball connecting member 10 rotates against the inner wall of the accommodating cavity 20A, to allow the backrest rod 300 to rotate relative to the frame 100.

In some embodiments, referring to FIG. 2, the ball connecting member 10 is arranged on the frame 100, and the limiting member 20 is arranged on the backrest rod 300. Specifically, the ball connecting member 10 is arranged on the rear side surface of the frame 100 and located at the connection where the frame 100 is spherically connected with the backrest rod 300, and the limiting member 20 is arranged at the end of the backrest rod 300 where the backrest rod 300 is spherically connected with the frame 100. In a configuration that the two opposite ends of the backrest rod 300 are spherically connected with the frame 100, each of the two opposite ends of the backrest rod 300 is provided with the limiting members 20, and each of two connection points on the frame 100 where the frame 100 is spherically connected to the two opposite ends of the backrest rod 300 is provided with the ball connecting members 10. When mounting the backrest rod 300 on the frame 100, the ball connecting members 10 on the frame 100 are inserted into the accommodating cavities 20A of the limiting members 20 on the backrest rod 300, to realize the spherical connection between the backrest rod 300 and the frame 100.

In some other embodiments, as shown in FIG. 1, the ball connecting member 10 may be arranged on the backrest rod 300, and the limiting member 20 may be arranged on the frame 100.

Figure 5:
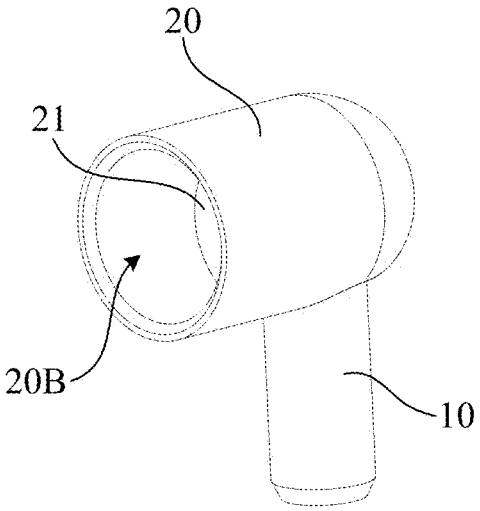
FIG. 5 is a schematic structural diagram of the part of the hanging chair in FIG. 3 from another perspective angle.

In some embodiments, referring to FIG. 3 to FIG. 5, the limiting member 20 is a limiting sleeve, and a partition part 21 is provided in the limiting sleeve. The partition part 21 partitions an inner cavity of the limiting sleeve into a socket cavity 20B and the accommodating cavity 20A. The backrest rod 300 is inserted into the socket cavity 20B and connected with the limiting sleeve. In the embodiments, the limiting sleeve is of a sleeve-like structure, and a partition part 21 is provided in the inner cavity of the limiting sleeve. The partition part 21 may be integrally formed with the limiting sleeve, or may be detachably arranged in the limiting sleeve. By disposing the partition part 21, the inner cavity of the limiting sleeve is divided into the socket cavity 20B and the accommodating cavity 20A. The socket cavity 20B and the accommodating cavity 20A are respectively located on two sides of the partition part 21 and are not communicated with each other. When mounting the limiting sleeve on the backrest rod 300, the backrest rod 300 may be inserted into the socket cavity 20B of the limiting sleeve from one end of the limiting sleeve, allowing for a socket connection between the backrest rod 300 and the limiting sleeve. When mounting the backrest rod 300 on the frame 100, the ball connecting member 10 on the frame 100 may be inserted into the accommodating cavity 20A of the limiting sleeve from the other end of the limiting sleeve and rotatably mated in the accommodating cavity 20A, allowing for the spherical connection between the backrest rod 300 and the frame 100. In some embodiments, the side of the partition part 21 facing the accommodating cavity 20A may be provided with an arc surface fitted the ball connecting member 10. When the ball connecting member 10 is accommodated in the accommodating cavity 20A, the ball connecting member 10 is rotatably mated with the arc surface of the partition part 21, to allow the ball connecting member 10 to rotate against the arc surface of the partition part 21. In a configuration that the backrest rod 300 is a hollow structure (for example, the backrest rod 300 is a hollow rod), the backrest rod 300 is inserted into the socket cavity 20B of the limiting sleeve, and the partition part 21 in the limiting sleeve can correspondingly block the opening at the end of the backrest rod 300, to seal the backrest rod 300. This prevents debris such as rust and other impurities inside the backrest rod 300 from leaking out through its opening.

The backrest rod 300 may be connected with the limiting sleeve in various ways.

In some embodiments, the limiting sleeve is defined with a first connecting hole, and the backrest rod 300 is defined with a second connecting hole corresponding to the first connecting hole. The limiting sleeve and the backrest rod 300 are connected by a first fastener mating with the first connecting hole and the second connecting hole. Specifically, the first connecting hole is defined in a peripheral wall of the limiting sleeve, and the second connecting hole is defined in a side wall of the backrest rod 300 and corresponding to the first connecting hole. One or more sets of the first connecting hole and the second connecting hole may be provided, and one or more first fasteners are correspondingly provided, which is not limited herein. When mounting the limiting sleeve, the backrest rod 300 is inserted into the socket cavity 20B of the limiting sleeve, the first connecting hole of the limiting sleeve is aligned with the second connecting hole of the backrest rod 300, and the first fastener is passed through the first connecting hole and the second connecting hole, realizing the connection between the limiting sleeve and the back rod 300. The first fastener may be a fastening rivet, a fastening screw, or the like.

In some other embodiments, the backrest rod 300 and the limiting sleeve may be connected by means of a snap-fit connection, an adhesive connection, or the like.

In some embodiments, referring to FIG. 3 to FIG. 5, the ball connecting member 10 includes a ball head part 11 and a connecting part 12 connected with the ball head part 11. A connecting column is protruded on the frame 100, and the connecting column is defined with an insertion hole. The connecting part 12 is inserted into the insertion hole and connected with the connecting column. The ball head part 11 of the ball connecting member 10 is accommodated in the accommodating cavity 20A. In the embodiments, the ball connecting member 10 includes the ball head part 11 and the connecting part 12 which may be integrally formed with the ball head part 11. The frame 100 is connected to the connecting part 12 of the ball connecting member 10 by the connecting column arranged on the frame 100, and the connecting column is defined with the insertion hole adapted for the ball connecting member 10. When mounting the ball connecting member 10 on the frame 100, the connecting part 12 of the ball connecting member 10 is inserted into the insertion hole of the connecting column on the frame 100 and connected to the connecting column, such that the ball connecting member 10 is connected with the frame 100. When mounting the backrest rod 300 on the frame 100, the ball head part 11 of the ball connecting member 10 is accommodated in the accommodating cavity 20A of the limiting member 20 and rotatably mated in the accommodating cavity 20A, to allow the backrest rod 300 to be spherically connected with the frame 100.

The connecting column on the frame 100 may be connected to the connecting part 12 of the ball connecting member 10 in various ways.

In some embodiments, the connecting part 12 is defined with a third connecting hole, and the connecting column is defined with a fourth connecting hole corresponding to the third connecting hole. The connecting column and the connecting part 12 are connected by a second fastener mating with the third connecting hole and the fourth connecting hole. Specifically, the third connecting hole is defined in a peripheral wall of the connecting part 12, and the fourth connecting hole is defined in a side wall of the connecting column and corresponding to the third connecting hole. One or more sets of the third connecting hole and the fourth connecting hole may be provided, and one or more second fasteners are correspondingly provided, which is not limited herein. When mounting the ball connecting member 10, the connecting part 12 of the ball connecting member 10 is inserted into the insertion hole of the connecting column, the third connecting hole of the connecting part 12 is aligned with the fourth connecting hole of the connecting column, then the second fastener is passed through the third connecting hole and the fourth connecting hole, thereby realizing the connection between the ball connecting member 10 and the frame 100. The second fastener may be a fastening rivet, a fastening screw, or the like.

In some other embodiments, the connecting column on the frame 100 and the connecting part 12 of the ball connecting member 10 may be connected by means of a snap-fit connection, an adhesive connection, or the like.

In some embodiments, referring to FIG. 3 and FIG. 4, the accommodating cavity 20A is defined with an opening in the end surface of the limiting member 20, and the side surface of the limiting member 20 is defined with an avoidance opening 20C communicated with the accommodating cavity 20A. The avoidance opening 20C is configured to allow a rotation of the ball connecting member 10 relative to the limiting member 20. Specifically, when the backrest rod 300 is subjected to an external force that causes it to rotate and fold, the ball connecting member 10 rotates against the inner wall of the accommodating cavity 20A, and the part of the ball connecting member 10 outside the accommodating cavity 20A gradually rotates from the axial direction of the accommodating cavity 20A to the radial direction of the accommodating cavity 20A. During this rotation process, the avoidance opening 20C avoids the part of the ball connecting member 10 located outside the accommodating cavity 20A, and this part of the ball connecting member 10 passes through the avoidance opening 20C, to allow the backrest rod 300 to rotate to the folded position parallel or substantially parallel to the frame 100, achieving the folding. When the backrest rod 300 is subjected to an external force that causes it to rotate and unfold, the ball connecting member 10 rotates against the inner wall of the accommodating cavity 20A, and the part of the ball connecting member 10 outside the accommodating cavity 20A gradually rotates from the radial direction of the accommodating cavity 20A to the axial direction of the accommodating cavity 20A. During this rotation process, the part of the ball connecting member 10 located outside the accommodating cavity 20A exits from the avoidance opening 20C, to allow the backrest rod 300 to rotate to the unfolded position where it forms an angle with the frame 100, achieving the unfolding.

In some embodiments, the seat 200 is rotatably arranged on the frame 100; and/or the seat 200 and the plurality of backrest rods 300 are connected by connecting straps L.

In the embodiments, the seat 200 is rotatably connected to the frame 100, such that the seat 200 is rotatably arranged on the frame 100. The seat 200 may be rotated on the frame 100 to the folded position parallel or substantially parallel to the frame 100, thereby realizing the folding; or the backrest rod 300 may be rotated on the frame 100 to the unfolded position, such as 90°, where it forms an angle with the frame 100, thereby realizing the unfolding. In some embodiments, the folding direction of the seat 200 is the same as the folding direction of the backrest rod 300, and the unfolding direction of the seat 200 is the same as the unfolding direction of the backrest rod 300. The seat 200 may be connected to the frame 100 by means of a planar hinge, a spherical connection, a shaft connection, etc., which is not limited herein.

In some embodiments, as shown in FIG. 1, the seat 200 and the plurality of backrest rods 300 are successively connected by connecting straps L. The connecting straps L serve to connect the plurality of backrest rods 300 and the seat 200, which ensures that in the unfolded state, the plurality of backrest rods 300 and the seat 200 are securely fixed on the frame 100, and maintain a sufficient strength to support the user's back. Moreover, since the connecting straps L have a certain degree of elasticity, they can absorb some of the impact force during the swing of the hanging chair to reduce the vibration transmitted to the user, thereby making the user's sitting experience more stable. The connecting straps L may be, for example, ropes, chains, etc., which is not limited herein.

Figure 6:
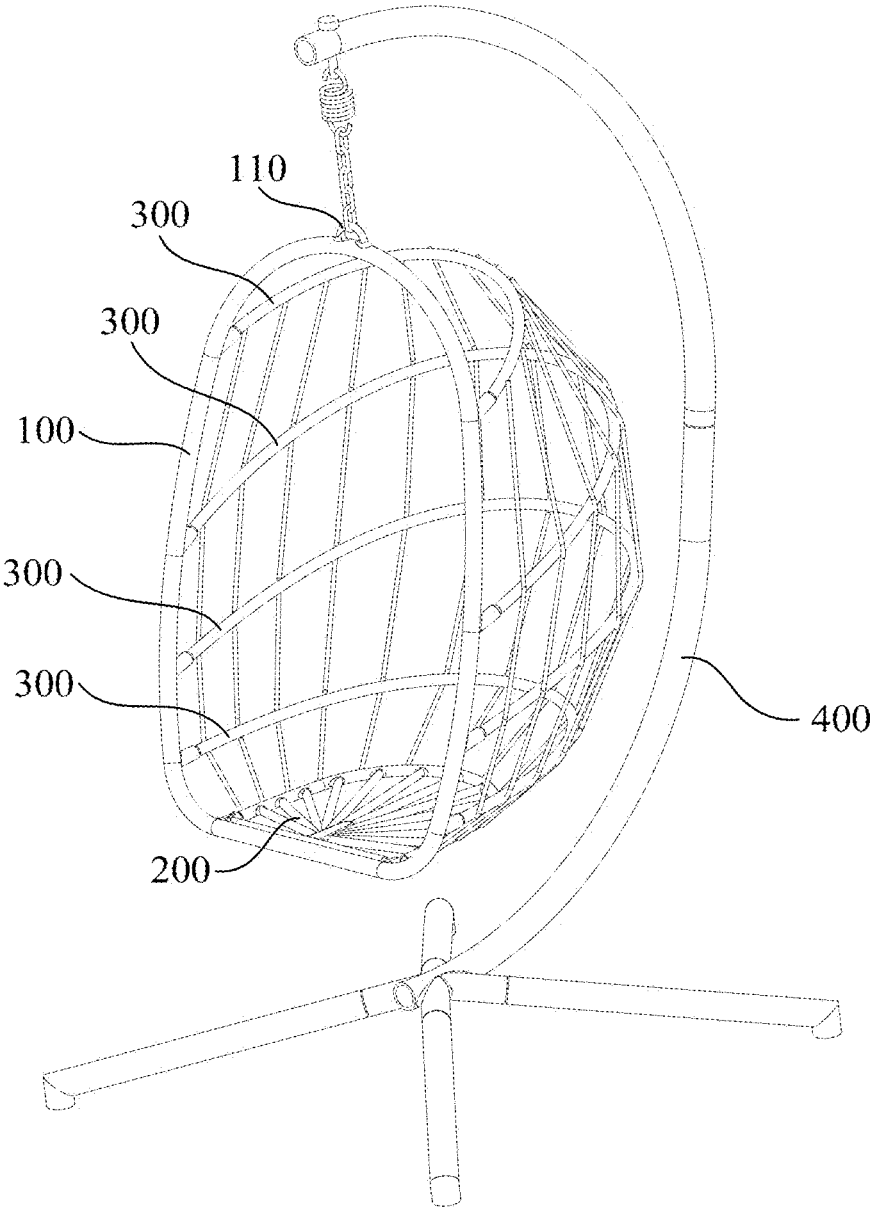
FIG. 6 is a schematic structural diagram of a hanging chair according to another embodiment of the present disclosure.

In some embodiments, as shown in FIG. 6, the hanging chair may further include a stand 400. The frame 100 is suspended/hung on the stand 400, to realize installation and support by the stand 400. This makes it convenient to move the hanging chair to different positions and offers flexible use.

The above are only some embodiments of the present disclosure, and neither the words nor the drawings can limit the protection scope of the present disclosure. Any equivalent structural transformation made by using the contents of the specification and the drawings of the present disclosure under the overall concept of the present disclosure, or directly/indirectly applied in other related technical fields are included in the protection scope of the present disclosure.

What is claimed is:

1. A hanging chair, comprising:

a frame;

a seat disposed on a side of the frame and connected with a bottom of the frame; and a plurality of backrest rods disposed on a side of the frame and arranged at intervals along a longitudinal direction of the frame, the plurality of backrest rods being rotatably arranged on the frame, and at least some of the plurality of backrest rods each has at least one end spherically connected with the frame; wherein, the ball connecting member is arranged on the frame, and the limiting member is arranged on the backrest rod;

wherein the limiting member is defined with an accommodating cavity, and the ball connecting member is rotatably mated in the accommodating cavity, to allow the backrest rod to be spherically connected with the frame;

the limiting member is a limiting sleeve, and a partition part is disposed in the limiting sleeve; wherein the partition part is configured to partition an inner cavity of the limiting sleeve into a socket cavity and the accommodating cavity, and the backrest rod is inserted into the socket cavity and connected with the limiting sleeve.

2. The hanging chair according to claim 1, wherein at least some of the plurality of backrest rods each has two opposite ends spherically connected with the frame; and/or, all of the plurality of backrest rods are spherically connected with the frame.

3. The hanging chair according to claim 1, wherein, the accommodating cavity is defined with an opening in an end surface of the limiting member, a side surface of the limiting member is defined with an avoidance opening communicated with the accommodating cavity, and the avoidance opening is configured to allow a rotation of the ball connecting member relative to the limiting member.

4. The hanging chair according to claim 1, wherein the seat is rotatably arranged on the frame; and/or, the seat and the plurality of backrest rods are connected by connecting straps.

* * * * *